US012038261B2

(12) United States Patent
Tedde

(10) Patent No.: US 12,038,261 B2
(45) Date of Patent: Jul. 16, 2024

(54) AMMUNITION FOR LIGHT FIREARMS

(71) Applicant: Salvatore Tedde, Ardara (IT)

(72) Inventor: Salvatore Tedde, Ardara (IT)

( * ) Notice: Subject to any disclaimer, the term of this patent is extended or adjusted under 35 U.S.C. 154(b) by 0 days.

(21) Appl. No.: 18/030,688

(22) PCT Filed: Oct. 11, 2021

(86) PCT No.: PCT/IB2021/059281
§ 371 (c)(1),
(2) Date: Apr. 6, 2023

(87) PCT Pub. No.: WO2022/079568
PCT Pub. Date: Apr. 21, 2022

(65) Prior Publication Data

US 2023/0408231 A1 Dec. 21, 2023

(30) Foreign Application Priority Data

Oct. 12, 2020 (IT) ..... 102020000023866

(51) Int. Cl.
*F42B 7/08* (2006.01)
*F42B 5/02* (2006.01)
(Continued)

(52) U.S. Cl.
CPC ..... *F42B 7/08* (2013.01); *F42B 7/02* (2013.01); *F42C 19/0807* (2013.01); *F42B 5/02* (2013.01); *F42B 5/26* (2013.01); *F42C 19/083* (2013.01)

(58) Field of Classification Search
CPC ..... F42B 5/00; F42B 5/02; F42B 5/26; F42B 7/02; F42B 7/08; F42C 19/08; F42C 19/0807; F42C 19/083; F42C 19/0823
(Continued)

(56) References Cited

U.S. PATENT DOCUMENTS 5,033,386 A * 7/1991 Vatsvog ..... F42B 5/307 102/467
5,259,288 A 11/1993 Vatsvog
(Continued)

FOREIGN PATENT DOCUMENTS

CA 2570743 A1 6/2008
WO 2016128387 A1 8/2016

OTHER PUBLICATIONS

Int'l. Search Report, Korean Intellectual Property Office, Jan. 27, 2022, received in Application No. PCT/IB2021/059281, 4 pages.
(Continued)

*Primary Examiner* — James S Bergin
(74) *Attorney, Agent, or Firm* — UB Greensfelder LLP; John X. Garred

(57) ABSTRACT

Ammunition (100, 100') for light firearms, the ammunition (100, 100') defining a longitudinal axis (X) and comprising: —a tubular casing (1, 1') containing gunpowder (2), provided with a base (3, 3') which delimits a hole (31, 31'); —a primer cartridge (4) which closes said hole (31, 31'); —at least one bullet (5) at least partially arranged in the casing (1, 1'); —a body (6), or base wad, made of polymeric material, defining a cavity (60'), arranged in the casing (1, 1'); wherein said body (6) comprises: a first part (61) having an outer surface in contact with the inner surface of the casing (1, 1'); and a second part (62), spaced apart from the inner surface of the casing (1, 1'), formed by a side wall (621) which extends from said first part (61), and by an upper wall (622), spaced apart from said first part (61), transverse to said side wall (621); characterized in that said side wall (621) is completely closed and comprises one or more portions (71, 72) adapted to break at the detonation of the primer cartridge (4, 4') so as to create a passageway (71*a*, 71*b*) at each of said one or more portions (71, 72); each portion (71, 72) of said one or more portions (71, 72) having a thickness, orthogo-
(Continued)

nally to the longitudinal axis (X), which is less than the remaining part (7) of said side wall (621).

10 Claims, 7 Drawing Sheets

(51) Int. Cl.
*F42B 5/26* (2006.01)
*F42B 7/02* (2006.01)
*F42C 19/08* (2006.01)

(58) Field of Classification Search
USPC ..... 102/430, 450, 451, 453, 461, 469, 470, 102/532
See application file for complete search history.

(56) References Cited

U.S. PATENT DOCUMENTS

| | | | | |
|---|---|---|---|---|
| 9,658,038 | B1 * | 5/2017 | Dunnam | F42B 7/08 |
| 10,107,608 | B2 * | 10/2018 | Tedde | F42C 19/083 |
| 2014/0060373 | A1 | 3/2014 | Maljkovic | |
| 2014/0261042 | A1 | 9/2014 | Imhoff | |

OTHER PUBLICATIONS

Written Opinion, Int'l. Searching Authority, Jan. 27, 2022, received in Int'l. Application No. PCT/IB2021/059281, 5 pages.

* cited by examiner

AMMUNITION FOR LIGHT FIREARMS

FIELD OF THE INVENTION

The present invention relates to ammunition, or cartridge, for light firearms, i.e., capable of being used and transported by a single person by virtue of small sizes and weight, such as for example, rifles and machine guns with a rifled barrel.

.50 BMG caliber ammunition, also known as 12.7×99 mm NATO, and a 12 caliber cartridge are non-limiting examples of this type of ammunition.

In particular, the invention relates to a body, or base wad, arranged in the casing of the ammunition.

BACKGROUND ART

A modern ammunition for firearms comprises a cartridge case, conventionally made of brass, containing the propellant, i.e., the gunpowder.

The cartridge case contains one or more bullets in the upper (or front) zone.

A primer cartridge (also called percussion) is arranged in the base of the cartridge case.

The weapon is ready to be fired when the ammunition is in the chamber in the weapon and the breechblock is closed.

The impact of the striker of the weapon on the primer cartridge induces the detonation of the triggering mixture contained therein, generating an intense flash which causes the lightning-fast ignition of all the available propellant, thus quickly developing a large amount of gas at a very high temperature, the pressure of which, being confined to a small volume, increases at exponential speed to very high values.

At this point, the pressure reaches the peak value, which threshold safety value is about 4000 bar, causing the bullet to accelerate along the barrel at increasing speed, up to leaving the muzzle.

Document WO2016128387 by the same Applicant describes .50 caliber BMG ammunition in which a metal bush is arranged in the bottom portion of the cartridge case thereof. The metal bush is provided with a bridge which length is equal to the diameter of the bush. The bridge is above an opening, in particular an upper opening, of the bush. Therefore, the bridge only partially obstructs the upper opening of the bush.

The bridge is adapted to intercept and deflect part of the triggering flame jet, thus obtaining a temporary fractionation of the ignition and combustion of the propellant, improving the distribution of the gas pressure which develops during the acceleration of the bullet along the barrel.

The same inventor has observed that such a deflector bridge is not adapted to obviate one drawback which occurs upon the detonation of the primer cartridge.

In particular, when intercepted and deflected by the deflector bridge, the triggering flame jet reaches the propellant, igniting it. However, the opening of the bush always allows the passage of excess flame on the propellant. Therefore, the deflector bridge substantially does not affect the dynamics of the ignition, combustion and propulsion process or affects it in a limited manner.

Therefore, there is a need to improve the aforesaid ignition, combustion and propulsion process. In particular, there is a need to improve the ignition dynamics so that it is always performed in optimal manner, such as to always deflect and free the predetermined and desired amount of triggering flame on the propellant and allow achieving the highest ballistic performance.

SUMMARY OF THE INVENTION

An object of the present invention therefore is to improve the ignition dynamics so that it is always performed in optimal manner, such as to always deflect and free the predetermined and desired amount of triggering flame on the propellant and allow achieving the highest ballistic performance.

The present invention achieves at least such an object, and other objects which will be apparent in light of the present description, by means of an ammunition for firearms, in particular light firearms, the ammunition defining a longitudinal axis and comprising:

- a tubular casing containing gunpowder, provided with a base which delimits a hole;
- a primer cartridge which closes said hole;
- at least one bullet at least partially arranged in the casing;
- a body, or base wad, preferably made of polymeric material, defining a cavity, arranged in the casing;
- wherein said body comprises:
- a first part having an outer surface in contact with the inner surface of the casing;
- and a second part, spaced apart from the inner surface of the casing, formed by a side wall which extends from said first part, and by an upper wall, spaced apart from said first part, transverse to said side wall;
- wherein said side wall is completely closed and comprises one or more portions adapted to break at the detonation of the primer cartridge so as to create a respective passageway, or opening;
- each portion of said one or more portions having a thickness, orthogonally to the longitudinal axis, which is less than the remaining part of said side wall.

The invention also relates to a body, or base wad, in particular as defined above.

Each of said one or more portions adapted to break at the detonation of the primer cartridge substantially is a diaphragm.

Advantageously, said one or more portions, or diaphragms, affect the level of intensity and width of the triggering flame, which ignition dynamics may be varied as needed, in particular as the thickness of said wall portions varies.

Preferably, the thickness, orthogonally to the longitudinal axis of the ammunition, is from 0.25 to 1 mm.

The aforesaid thickness range was carefully selected on the basis of several experimental tests.

Advantageously, selecting a thickness from 0.25 to 1 mm considerably improves the ballistics, as needed. In particular, the intensity of the triggering flame increases as the thickness decreases.

By mere way of non-limiting example, ammunition according to the invention may be of the .50 BMG type or of the 12 caliber type.

Further features and advantages of the invention will become more apparent in light of the detailed description of non-exclusive embodiments.

The dependent claims describe particular embodiments of the invention.

BRIEF DESCRIPTION OF THE DRAWINGS

In the description of the invention, reference is made to the accompanying drawings, which are provided by way of a non-limiting example, in which.

The same elements, or functionally equivalent elements, have the same reference numeral.

DESCRIPTION OF EMBODIMENTS OF THE INVENTION

Figure 1:
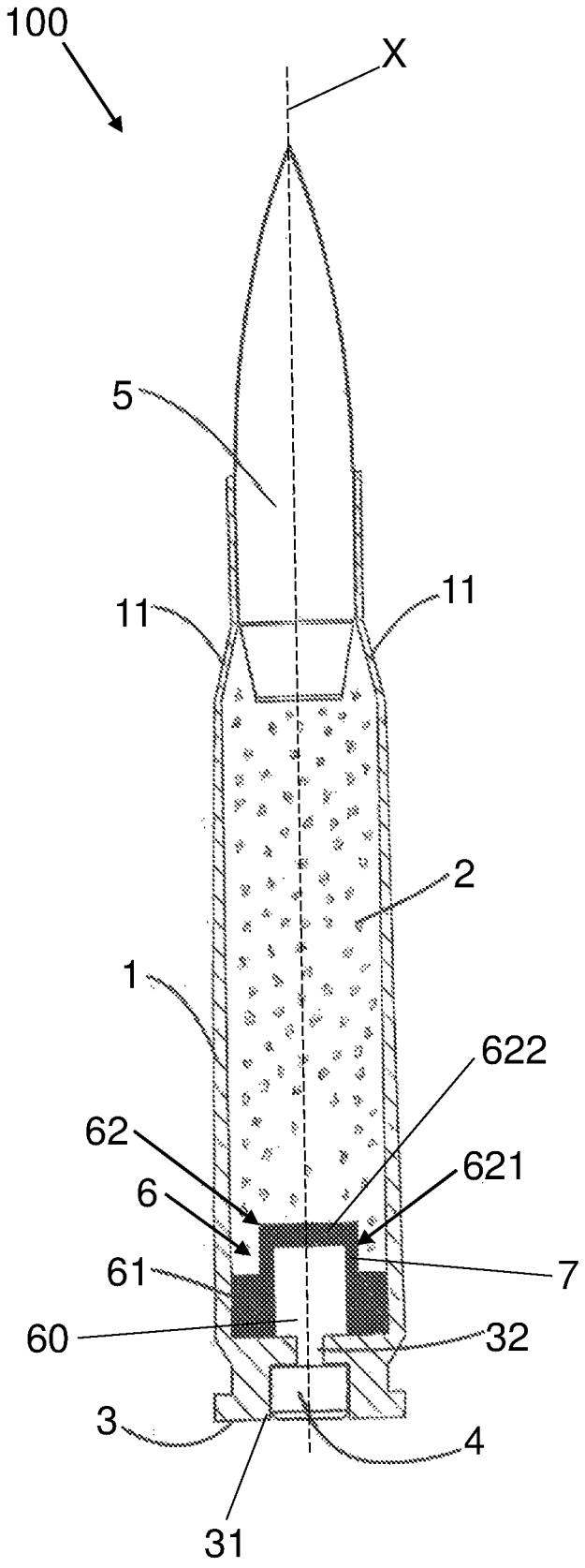
FIG. 1 shows a sectional view of an example of ammunition according to the invention.

With reference to the drawings, non-limiting embodiments of an ammunition 100, 100' for firearms according to the invention are described.

Ammunition 100, 100' in particular is an ammunition for light firearms, i.e., capable of being used and transported by a single person by virtue of the contained sizes and weight, such as for example, rifles and machine guns with a rifled barrel.

In all the embodiments, the ammunition 100, 100', or cartridge, defines a longitudinal axis X and comprises:

- a tubular casing 1, 1' containing gunpowder 2, provided with a base 3, 3', or bottom, which delimits a hole 31, 31';
- a primer cartridge 4 which closes said hole 31, 31';
- at least one bullet 5 at least partially arranged in casing 1, 1';
- a body 6, or base wad, preferably made of polymeric material, defining a cavity 60, arranged in the casing 1, 1';
- wherein said body 6 comprises, preferably consists of,
- a first part 61 having an outer surface 611 in contact with the inner surface of casing 1, 1';
- and a second part 62, spaced apart from the inner surface of casing 1, 1', formed by a side wall 621 which extends from said first part 61, and by an upper wall 622, spaced apart from said first part 61, transverse to said side wall 621;
- wherein said side wall 621 is completely closed and comprises one or more portions 71, 72 adapted to break at the detonation of the primer cartridge 4 so as to create a passageway 71*a*, 71*b*, or opening, at each of said one or more portions 71, 72;
- each portion 71, 72 of said one or more portions 71, 72 having a thickness, orthogonally to the longitudinal axis X, which is less than the remaining part 7 of said side wall 621.

Figure 8:
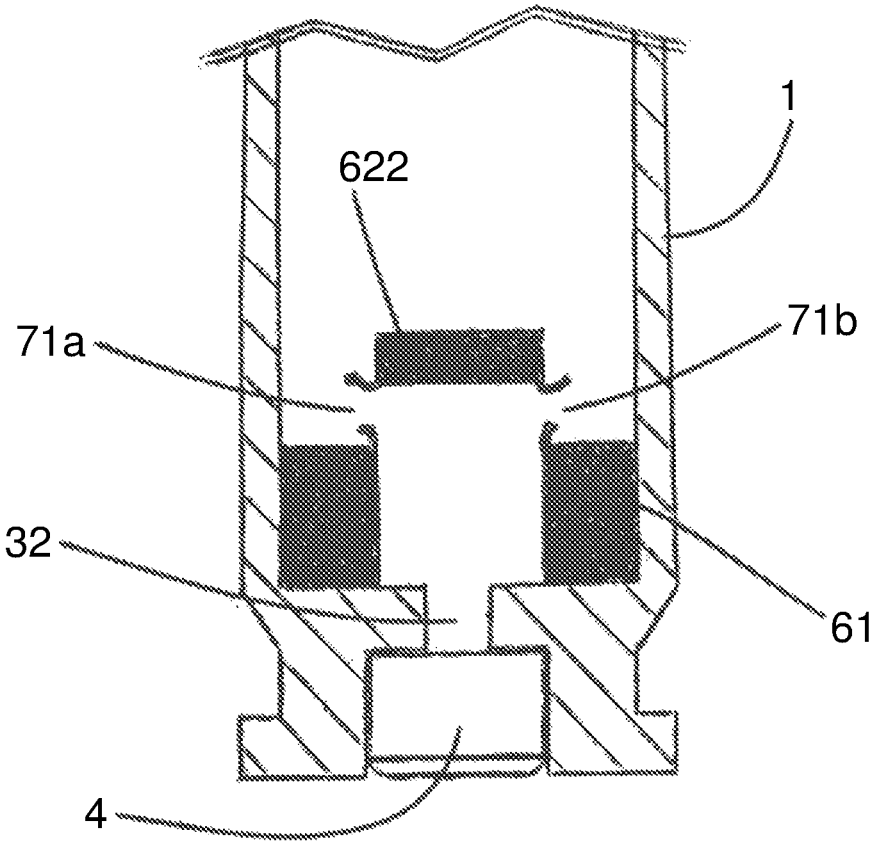
FIG. 8 shows a view similar to FIG. 2, in which two parts are broken following the detonation of the primer cartridge of the ammunition.

In FIG. 8, the two portions 71, 72 are broken, in particular torn apart, following the detonation of the primer cartridge 4. The passageways, or openings, formed are indicated by numerals 71*a*, 71*b*.

Preferably, body 6 is made of polyethylene, preferably high-density polyethylene (HDPE).

Preferably, body 6 is monolithic.

Preferably and advantageously, said thickness of each of the one or more portions 71, 72 is from 0.25 to 1 mm.

Figure 3:
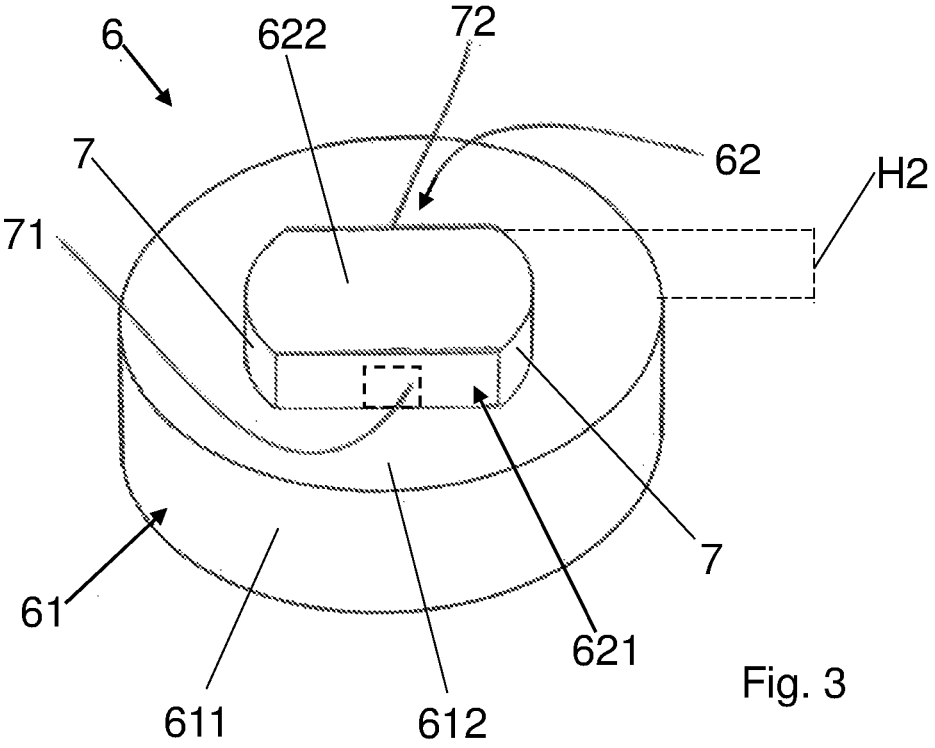
FIG. 3 shows a perspective view of a component of ammunition according to the invention.
Figure 4:
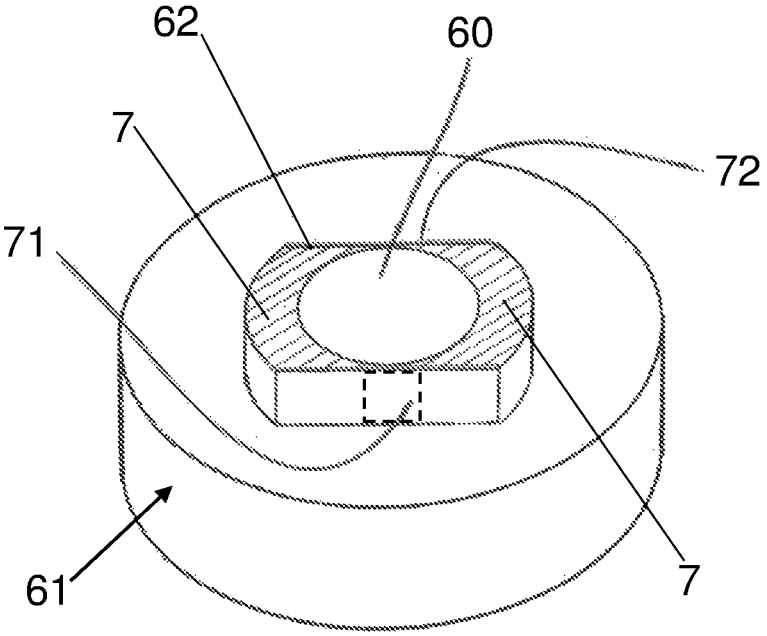
FIG. 4 shows a perspective view of the component in FIG. 3, cross-sectioned on a plan.

In FIGS. 3 and 4, zone 71 is diagrammatically indicated by means of a dashed rectangle.

Preferably, each portion 71, 72 has an area from 1 to 15 $mm^2$. Said area in particular is measured on a surface of the side wall 621, for example on the outer surface of the side wall 621. The dimension of said area affects the intensity and amplitude of the triggering flame which in particular, increase as said area increases.

The aforesaid remaining part 7 of the side wall 621 in particular is designed to remain integral, or substantially integral, i.e., not to break, at the detonation of the primer cartridge 4.

Preferably, said remaining part 7 of the side wall 621 has a thickness, orthogonally to the longitudinal axis X, of at least 3 mm, preferably from 3 to 4 mm.

Preferably, but not exclusively, body 6 comprises two portions 71, 72, for example only two portions 71, 72, adapted to break at the detonation of the primer cartridge 4, such as in the examples shown in the drawings. Preferably, said two portions 71, 72 are opposite to each other, in particular with respect to the longitudinal axis X.

In variants not shown, a single portion may be provided, or more than two portions adapted to break at the detonation of the primer cartridge 4, may be provided.

The aforesaid longitudinal axis X is also the longitudinal axis of casing 1, 1'. The aforesaid longitudinal axis X preferably is also the central axis of ammunition 100, 100', in particular of casing 1, 1'.

The longitudinal axis X in particular crosses the upper wall 622, the hole 31, and the primer cartridge 4.

The part 61 of body 6 comprises the aforesaid outer surface 611, which preferably is cylindrical, and an upper surface 612 (see in particular, FIG. 3).

The outer surface 611 in particular is an outer side surface and extends about the longitudinal axis X. The inner surface of casing 1, 1' is cylindrical at part 61.

Preferably, substantially the whole outer surface 611 is in contact with a cylindrical portion of casing 1, 1', which is at part 61.

The upper surface 612 is transverse, preferably orthogonal or substantially orthogonal, to the outer surface 611. Advantageously, the upper surface 612 of part 61 is completely closed.

More generally, advantageously the whole upper surface of body 6, which comprises, in particular consists of, the upper surface 612 and the upper surface of the upper wall 622, is completely closed. The upper surface of body 6 in particular is proximal to said at least one bullet 5 and distal from base 3, 3'.

The upper surface of body 6, in particular the upper surface 612 and the upper surface of the upper wall 622, and the outer surface of the side wall 621, are in contact with gunpowder 2.

Figure 5:
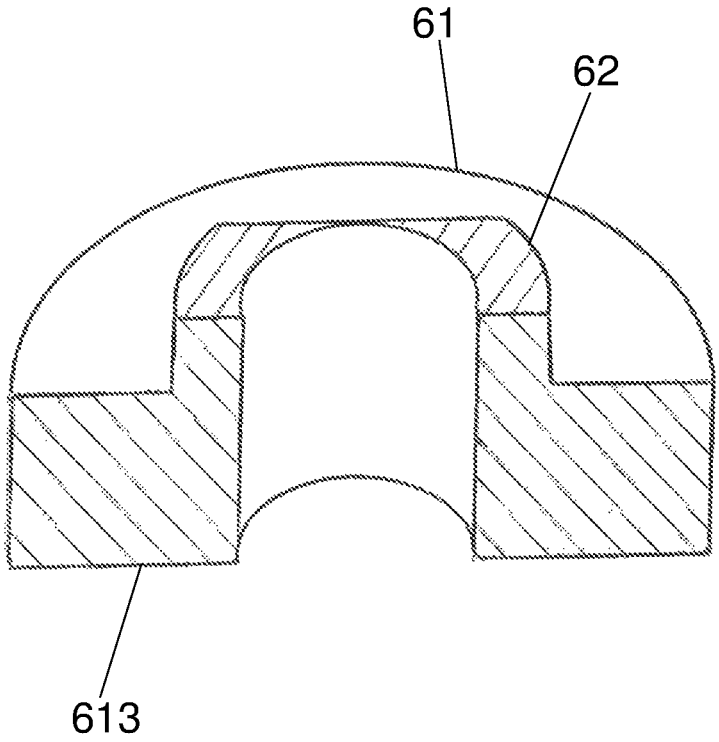
FIG. 5 shows a perspective view of the component in FIG. 3, cross-sectioned on two plans.
Figure 6:
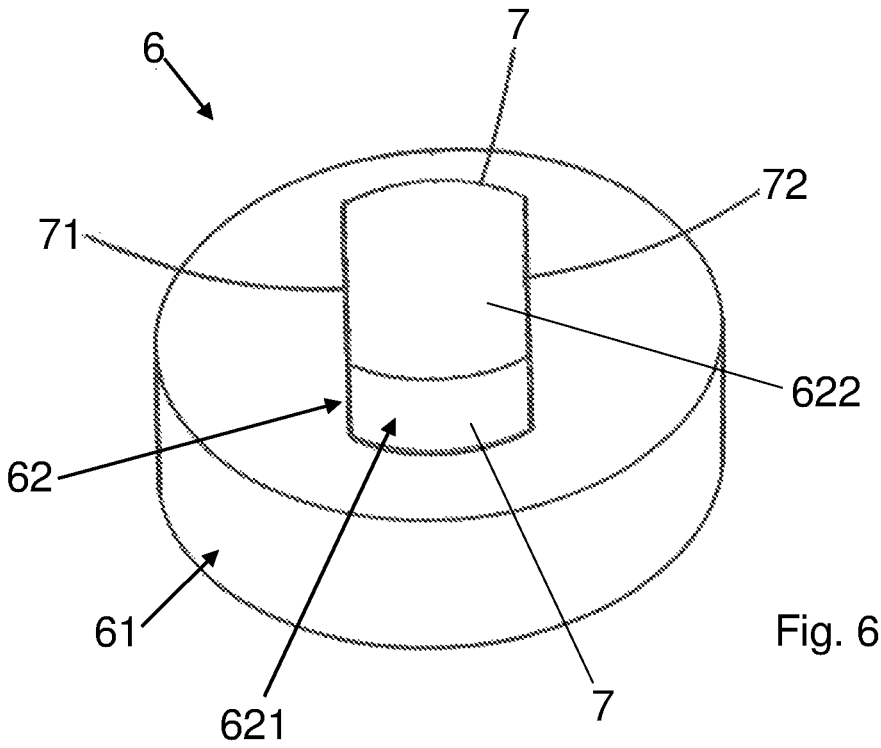
FIG. 6 shows another perspective view of the component in FIG. 3, rotated by about 90° about the axis X with respect to FIG. 3.
Figure 7:
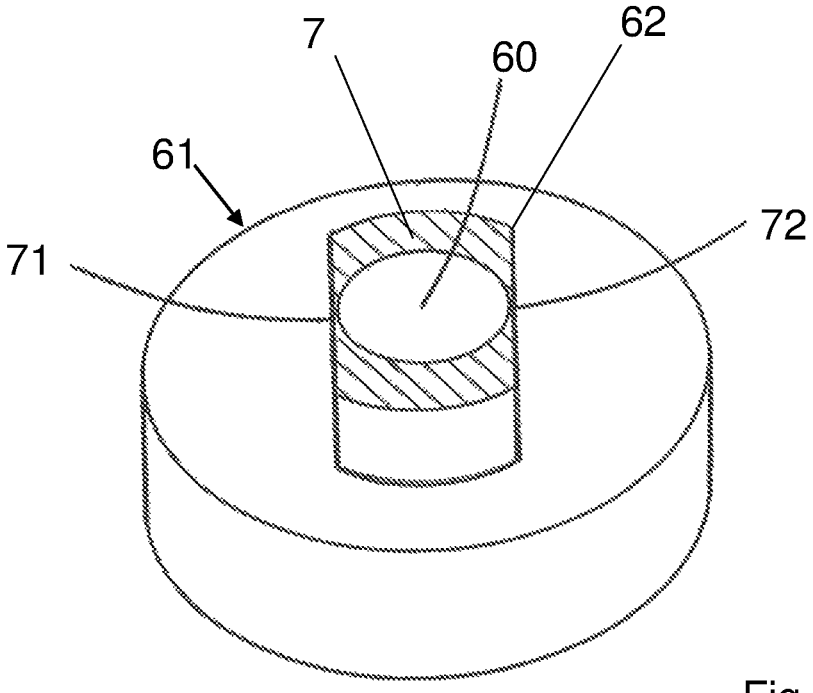
FIG. 7 shows a perspective view of the component in FIG. 6, cross-sectioned on a plan.

Body 6 is in contact with base 3, 3'. In particular, the lower surface 613 (indicated in FIGS. 2 and 5) of part 61, which corresponds to the lower surface of body 6, is in contact with base 3, 3'.

Part 62 substantially is a protrusion, or projection, with respect to part 61, whereby there is a step between part 61 and part 62. In particular, said step is between the upper surface 612 of part 61 and the upper surface of the upper wall 622 of part 62.

In other words, the upper surface 612 and the upper surface of the upper wall 622 are spaced apart from each other.

The second part 62 of body 6 has a height H2 (indicated in FIG. 3), parallel to the longitudinal axis X, starting from the first part 61, which preferably is from 1 to 15 mm, for example from 5 to 15 mm. Height H2 corresponds to the height of said step, i.e., the distance between the upper surface 612 of part 61 and the upper surface of the upper wall 622 of part 62.

Preferably, the upper surface of the upper wall 622 is orthogonal, or substantially orthogonal, to the longitudinal axis X.

The upper wall 622 substantially forms a bridge.

The upper wall 622 preferably is adjacent to the side wall 621.

Preferably, the overall height of body 6, parallel to the longitudinal axis X, is from 10 to 20 mm. Said overall height of body 6 comprises the height H2.

By mere way of example, preferably the overall height of body 6 is from 10 to 20% of the overall height, parallel to the longitudinal axis X, of ammunition 100, 100'. In particular, for example, for ammunition 100 of the .50 BMG type, said overall height of body 6 preferably is from 10 to 15% of the overall height, parallel to the longitudinal axis X, of ammunition 100; and for example, for ammunition 100' of the 12 caliber type, said overall height of body 6 preferably is equal to or about equal to 20% of the overall height, parallel to the longitudinal axis X, of ammunition 100'.

Each portion 71, 72 is spaced apart, in particular always spaced apart, from the inner surface of casing 1, 1'.

Preferably, the whole side wall 621 is spaced apart, in particular always spaced apart, from the inner surface of casing 1, 1'. In other words, the maximum width of part 62, orthogonally to the longitudinal axis X, is less than the inner diameter of casing 1, 1', at least at part 62. The side wall 621 in particular is not intersected by the longitudinal axis X.

Preferably, but not exclusively, each portion 71, 72 substantially is flat.

As mentioned above, body 6 delimits a cavity 60. In particular, the part 61 of body 6 delimits an opening of said cavity 60. Said opening is coaxial to said hole 31, 31' of base 3, 3'. Said opening is an opening of the lower surface 613 of part 61.

Cavity 60 in particular is delimited by the inner surface of part 61 and by the inner surface of the part 62 of body 6. In particular, the inner surface of the upper wall 622 forms the bottom of cavity 60. The side surface which delimits cavity 60 preferably is cylindrical.

The skilled technician may increasingly appreciate the advantages of the invention with a description of the shooting process of ammunition 100, 100'.

During the shooting, the impact of the striker on the primer cartridge 4 induces the detonation of the triggering mixture therein contained, giving rise to an intense flash which impacts on the inner surface of the upper wall 622, causing the breaking of the one or more portions 71, 72, whereby an opening 71*a*, 71*b* (FIG. 8) is formed at each portion 71, 72.

The intense jets of flame escaping through the one or more openings 71*a*, 71*b* enter in lightning-fast manner in the part of casing 1 in which there is the gunpowder 2, which is ignited and combusted.

In such a first step of shooting, due to the effect of the presence of the upper wall 622 and of the one or more portions 71, 72, the share of gunpowder 2 which starts to burn is less with respect to ammunition, for example, of the type described in WO2016128387. Therefore, the peak of pressure generated with ammunition 100, 100' according to the invention never exceeds the safety threshold corresponding to about 4000 bar. Bullet 5 thus undergoes the primary acceleration along the barrel. In the second step of shooting, the very high temperature reached ignites the remaining gunpowder 2 in lightning-fast manner, which level of combustion liveliness generates an equally lightning-fast production of gas pressure such to exert a greater impulse on bullet 5.

Advantageously, bullet 5 thus reaches a 20% greater muzzle speed, which develops a 45% greater kinetic energy with respect to the ballistic values which can be obtained according to the prior art.

It should be noted that body 6 is not a triggering device, rather a supplementary component to the triggering device of the ammunition, the latter comprising the primer cartridge 4.

Figure 2:
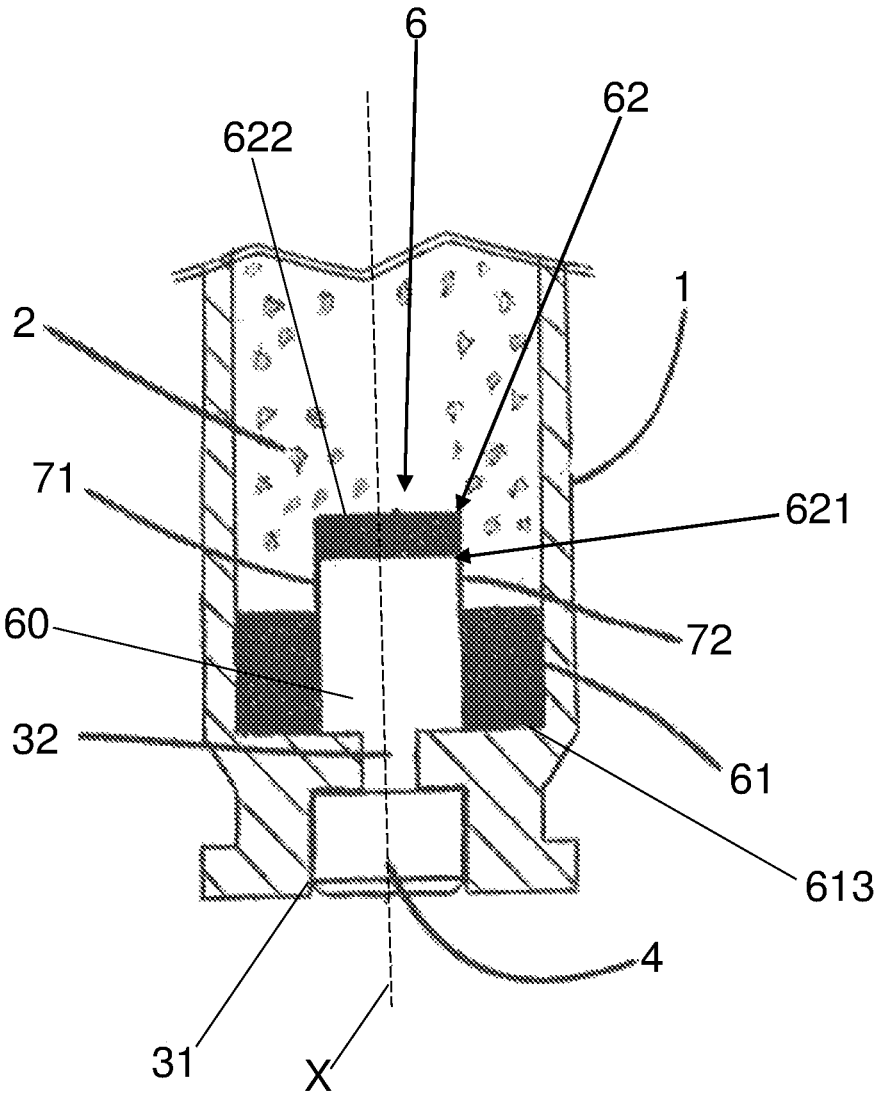
FIG. 2 shows a sectional view of a part of the ammunition in FIG. 1, rotated by 90° about the longitudinal axis X with respect to FIG. 1.

With particular reference to FIGS. 1, 2 and 8, ammunition 100 of the .50 BMG (Browning Machine Gun) type is shown, i.e., of the NATO 12.7×99 mm type, in which base 3 is part of casing 1, or cartridge case. In other words, casing 1 and base 3 form a monolithic component.

There is one bullet 5 only, partially inserted in casing 1.

The primer cartridge 4 is inserted in the hole 31 of base 3. Base 3 also delimits a flame hole 32. The incendiary flame generated by the detonation of the primer cartridge 4 may pass through the flame hole 32.

Hole 31 and the flame hole 32 are coaxial to each other. The flame hole 32 is closed on the bottom by the primer cartridge 4. The flame hole 32 communicates with cavity 60 on the top.

Body 6 preferably is inserted in casing 1 prior to the tapering operation with which the frustoconical portion 11 (FIG. 1) of casing 1 is obtained.

The primer cartridge 4 in ammunition 100 is completely external to body 6.

Figure 9:
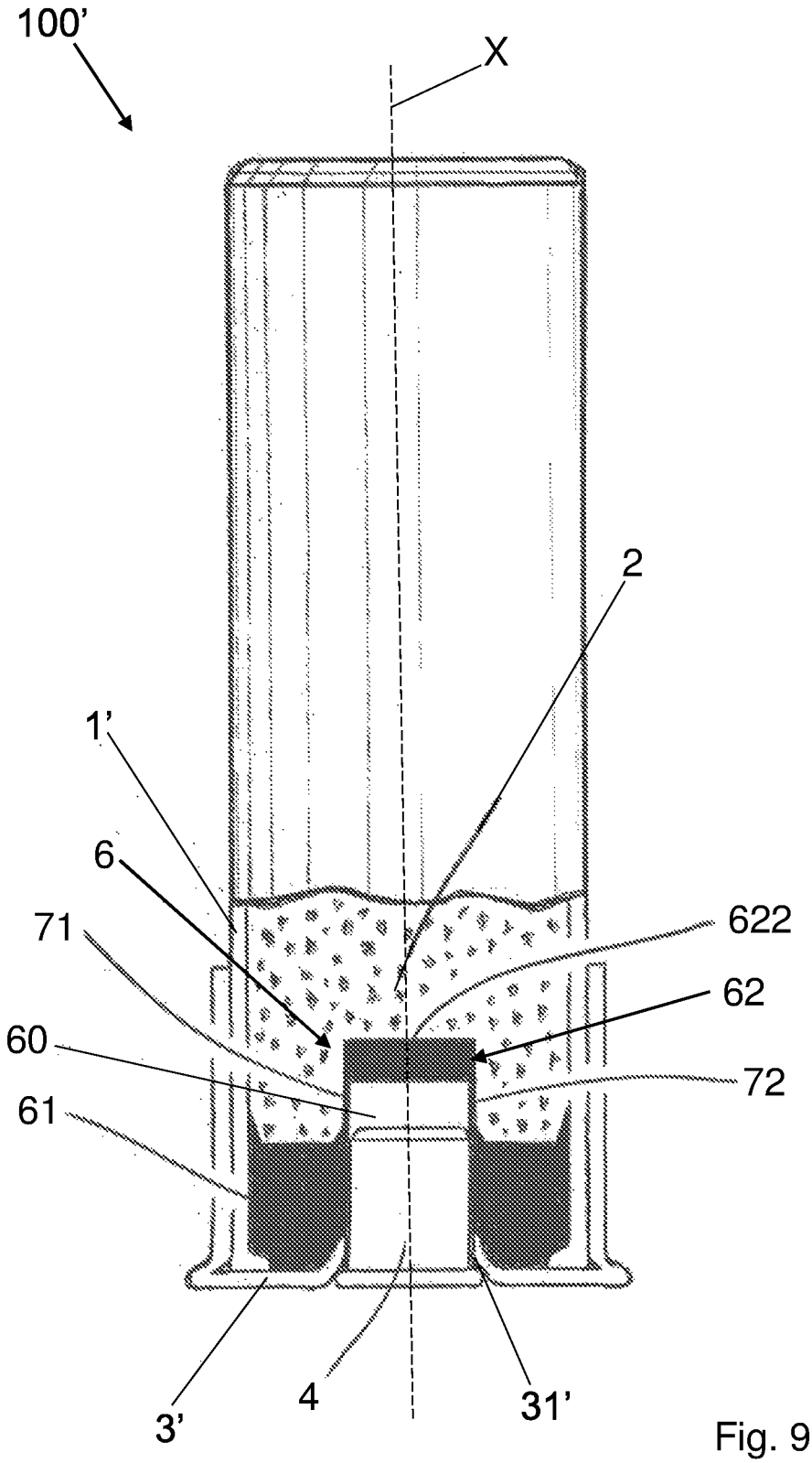
FIG. 9 shows a partial sectional view of another example of ammunition according to the invention.

With particular reference to FIG. 9, it shows ammunition 100' of the 12 caliber type, in which base 3' is a distinct body with respect to casing 1' and is fastened to casing 1'. The primer cartridge 4 is inserted in hole 31' and in the cavity 60 of body 6, in particular so that the primer cartridge 4 and the upper wall 622 are spaced apart from each other, being separated from each other by an empty space.

A plurality of bullets (not shown) completely contained within casing 1' preferably is provided in this type of ammunition 100'.

It is apparent that the invention is not limited to the two specific types of ammunition described.

The invention claimed is:

1. Ammunition for firearms, in particular light firearms, the ammunition defining a longitudinal axis and comprising:

a tubular casing containing gunpowder, provided with a base which delimits a hole;

a primer cartridge which closes said hole;

at least one bullet at least partially arranged in the casing; and a body, or base wad, made of polymeric material, defining a cavity, arranged in the casing;

wherein said body comprises a first part having an outer surface in contact with the inner surface of the casing; and a second part spaced apart from the inner surface of the casing, formed by a side wall which extends from said first part, and by an upper wall, spaced apart from said first part, transverse to said side wall;

wherein said side wall is completely closed and comprises one or more portions adapted to break at the detonation of the primer cartridge so as to create a respective passageway; and wherein each portion of said one or more portions having a thickness, orthogonally to the longitudinal axis, which is less than the remaining part of said side wall.

2. The ammunition according to claim 1, wherein said thickness is from 0.25 to 1 mm.

3. The ammunition according to claim 1, wherein said body is made of polyethylene, in particular high-density polyethylene (HDPE).

4. The ammunition according to claim 1, comprising two portions of said one or more portions adapted to break at the detonation of the primer cartridge; said two portions being opposite to each other.

5. The ammunition according to claim 1, wherein each portion of said one or more portions has an area from 1 to 15 $mm^2$.

6. The ammunition according to claim 1, wherein said remaining part of said side wall has a thickness, orthogonally to the longitudinal axis, of at least 3 mm, preferably from 3 to 4 mm.

7. The ammunition according to claim 1, wherein said first part of the body delimits an opening of said cavity which is coaxial to said hole of the base.

8. The ammunition according to claim 1, wherein said cavity is delimited by an inner surface of said first part and by an inner surface of said second part of the body.

9. The ammunition according to claim 1, wherein said second part of the body has a height (H2), parallel to the longitudinal axis, starting from the first part, from 1 to 15 mm.

10. The ammunition according to claim 1, wherein said upper wall is completely closed; wherein an upper surface of the body consists of an upper surface of said first part and an upper surface of the upper wall, is completely closed.

* * * * *